United States Patent [19]

Justus

[11] 3,937,410

[45] Feb. 10, 1976

[54] METHOD OF AND MEANS FOR CONTROLLING INTERNAL TENSION IN WEB ROLLS

[75] Inventor: Edgar J. Justus, Beloit, Wis.

[73] Assignee: Beloit Corporation, Beloit, Wis.

[22] Filed: Jan. 16, 1975

[21] Appl. No.: 541,505

[52] U.S. Cl. ..... 242/66

[51] Int. Cl.[2] ..... B65H 17/08

[58] Field of Search..... 242/66, 65, 58.6, 67.1 R

[56] References Cited

UNITED STATES PATENTS

| | | | |
|---|---|---|---|
| 1,851,605 | 3/1932 | Valentine | 242/66 |
| 3,000,584 | 9/1961 | Clem | 242/66 |
| 3,079,101 | 2/1963 | Rockstrom | 242/66 |
| 3,104,845 | 9/1963 | Patterson | 242/66 |
| 3,232,549 | 2/1966 | Stumbaugh | 242/66 |

*Primary Examiner*—Edward J. McCarthy
*Attorney, Agent, or Firm*—Hill, Gross, Simpson, Van Santen, Steadman, Chiara & Simpson

[57] ABSTRACT

A method of and means for controlling internal tension in web rolls during winding thereof onto cores with the aid of winding drums, comprises partially winding the web rolls between the winding drums and a rider roll, backing off the rider roll from the web rolls after they have attained partial diameter, and during continuance of the winding of the web rolls to full diameter applying load-relieving lift to the web rolls through their cores. A lifting device is correlated with the operation of a winder.

20 Claims, 4 Drawing Figures

53
54
55
30
52
50
51
29
31
52
22
27
24
10
32
21
25
11
18
28
32
19
20
62
63
IV
64
IV
61
59
57
II
17
33
15
34
15
35
34
14
17
65
II
23
23
15
67
12
13

METHOD OF AND MEANS FOR CONTROLLING INTERNAL TENSION IN WEB ROLLS

This invention relates to the art of winding web rolls, more particularly paper rolls, and is especially directed to improving the quality of paper rolls of large diameter.

Rolls of sheet or web material, and more particularly paper, are commonly wound in a winder comprising a pair of winding drums which drive the web rolls under a variable position rider roll controlling the pressure in the nips between the winding drums and the web roll in order to control compactness of the web rolls. The rider roll is gradually eased from the web rolls as the web rolls increase in diameter and weight because the increasing weight of the web rolls contributes to maintaining adequate tension in the nips. After the size of the rolls has developed to a calculable weight, however, there is increasing tension to the extent that unless great care is exercised internal forces may develop in the roll causing breaks at weaker areas of the web. Various and sundry web tensioning devices have been proposed to alleviate this problem. Such devices have required sophisticated tension monitoring and control systems which are costly to install and to maintain and require relatively careful and accurate adjustments for optimun results.

An important object of the present invention is to overcome the foregoing and other disadvantages, shortcomings, deficiencies, inefficiencies, and problems and to provide new and impoved method of and means for controlling internal tension in web rolls and more particularly heavy paper rolls.

Another object of the invention is to control web tension in the winding of rolls in a winder in which the rolls are rotated while riding on winding drums.

A further object of the invention is to provide a new and improved method of and means for controlling internal tension in web rolls by compensating for increasing weight of the rolls while they are wound on winding drums.

Still another object of the invention is to provide a new and improved method of and means for controlling internal tension in web rolls permitting larger sizes of rolls to be wound safely in and with existing winding apparatus.

Yet another object of the invention is to provide new and improved means which can be easily and conveniently installed in existing winders for controlling internal tension in web rolls.

To the attainment of the foregoing objects, the present invention provides a method of controlling internal tension in web rolls during winding thereof onto cores with the aid of winding drums, comprising partially winding the web rolls between the winding drums and a rider roll, backing off the rider roll from the web rolls after the web rolls have reached partial size, and during continuance of the winding to full diameter applying roll relieving lift to the web rolls through their cores. In one form apparatus for this purpose comprises means in the form of lifting devices applying lift to the roll cores adjacent to the ends of the rolls.

Other objects, features and advantages of the invention will be readily apparent from the following description of a preferred embodiment thereof, taken in conjunction with the accompanying drawings although variations and modifications may be effected without departing from the spirit and scope of the novel concepts embodies in the disclosure, and in which.

Figure 1:
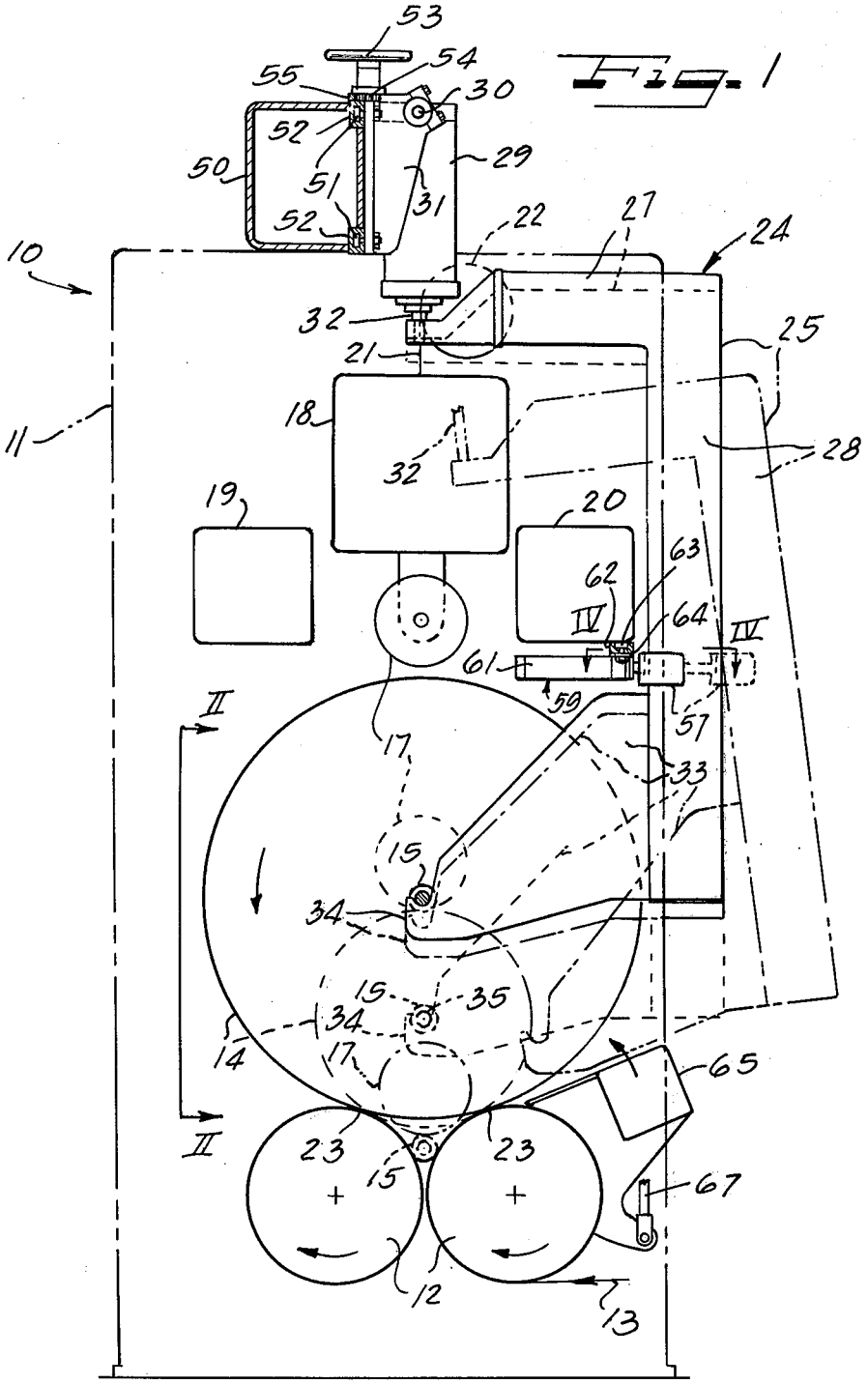
FIG. 1 is a schematic side elevational view of a winder embodying features of the invention.

On reference to FIG. 1, winder 10 is depicted schematically comprising a supporting frame 11 within which is supported a pair of winding rolls or drums 12 suitably driven in a common direction of rotation as indicated on parallel axes disposed in a horizontal plane and with the adjacent perimeters of the winding rolls spaced apart at least far enough to pass freely a web 13 of material such as paper delivered from a suitable source such as a reel or paper making machine (not shown) and traveling under and over one of the drums 12 to be wound by the winding drums into one or more tightly wound web rolls 14. In a preferred arrangement, a plurality of the web rolls 14 are adapted to be wound simultaneously in the winder 10 from a source web of ample width for the purpose slit before reaching the winder 10 by any suitable slitting apparatus (not shown) to provide the length of rolls desired. Newsprint rolls may range in length from ten inches to forty inches and the winder may be from 300 to 400 inches wide to permit a maximun number of rolls to be wound in each winding operation. In the winder 10, it is desirable according to the present invention to wind the rolls up to 60 to 72 inches in diameter.

As the start of a winding operation, the web strips are attached at their starting ends to tubular cores 15 (FIGS. 1, 2 and 3) placed initially in the trough opening upwardly between the winding drums 12. A rider roll 17 is moved onto the cores 15 to apply nip pressure of the cores 15 against the winding drums 12 sufficient to assure non-slip driving of the cores 15 and the developing web rolls 14 in the relatively high speed rotation of the winding drums 12. Pressure loading of the rider roll 17 is suitably maintained by means including a rider roll beam 18 which is suitably guided for vertical travel between a pair of horizontal spaced frame beams 19 and 20. Suitable means for controlling raising and lowering of the rider roll beam 18 include cable means 21 trained over pulley means 22 mounted in the upper portion of the frame 11, and suitable driving and control means (not shown) and which may be of a type known for this purpose.

Continuously as each of the web rolls 14 is wound, pressure at the nips 23 with the winding drums 12 must be maintained to assure tight winding of the web sheet in the roll. However, as the roll gets bigger and heavier the weight of the roll causes the nips 23 to get bigger, which, if unrelieved, progressively increases tension in the wound web as the size of roll increases until the rupture point is reached. Up to a certain weight nip pressure relief is obtained by gradually decreasing the load of the rider roll 17 from an initial maximun pressure load at the start of the winding operation, to a zero load relationship at the point at which the weight of the web roll 14 is sufficient to maintain adequate nip pressure of its own dead weight. For example, with newsprint a web roll diameter of about thirty inches attains a self loading weight at the nips 23 sufficient to maintain a desired web tension. Therefore, as the size of roll gradually increases from core diameter to the 30 inch diameter, the rider roll pressure load is progressively reduced to compensate for the increasing web roll weight. However, beyond the 30 inch diameter, the increasing web roll weight progressively builds up the load at the nips 23, with indentation of the winding drum perimeter into the web roll as the weight increases with consequent rapid buildup of lineal tension in the sheet and development of damaging internal tension in the web roll.

According to the present invention, after the web roll 14 has reached a size in the winding operation where the roll weight equals the desired tensioning load at the nips 23, so that the rider roll 17 is released from loading the web roll, continuous high speed winding of the web roll to a desired maximum size, that is full diameter, is continued while achieving a substantially optimum lineal web tension as a continuation of the web tension attained by aid of the rider roll in the first stage of web roll winding. This desirable result is attained by applying load relief lifting to the web rolls 14 through their cores 15. For this purpose, the winder 10 is provided with means comprising lifter devices 24 constructed and arranged to apply load-relieving lift to the web rolls 14 through the cores 15.

Figure 2:
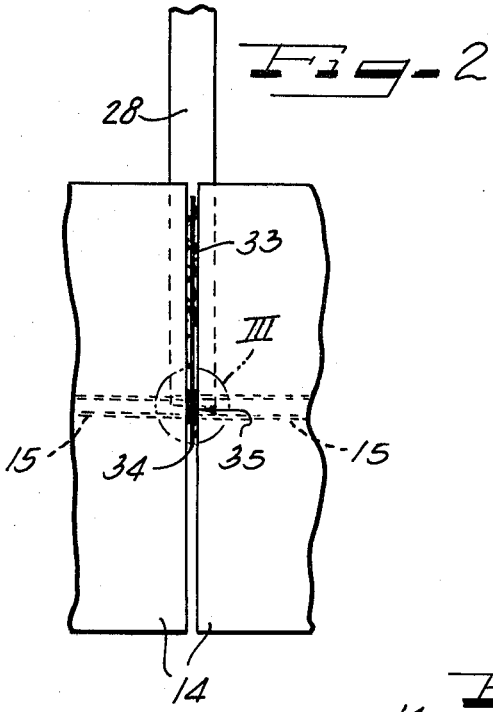
FIG. 2 is a fragmentary elevational view taken substantially in the plane of line II—II of FIG. 1.
Figure 3:
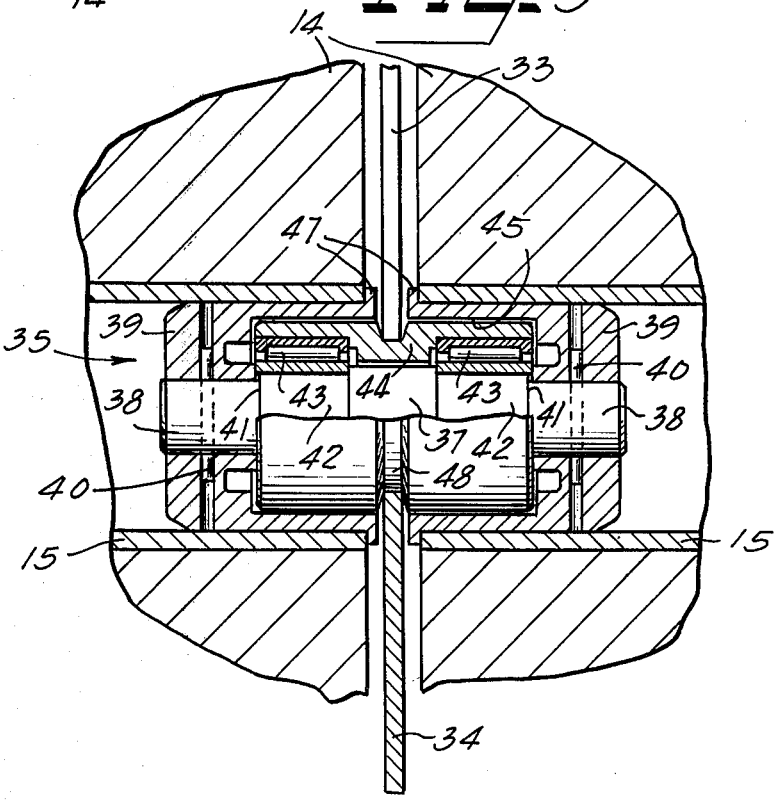
FIG. 3 is an enlarged vertical sectional detail view taken substantially in the area III of FIG. 2.

Each of the lifters 24 is constructed and arranged to be capable of applying lift to the outer ends of the endmost of the web rolls 14 in an aligned series and also to the adjacent ends of the contiguous rolls in the series. Desirably all of the lifters are of a standarized construction and therefore description of one of the lifters 24 will suffice for all that may be employed in the winder 10 regardless of its size. Each of the lifters 24 is of generally C-shape in side elevation, comprising a preferably hollow tubular inverted L-shaped frame 25 provided with a short head arm 27 projecting forwardly from a downwardly extending longer arm 28 located in suitable clearance relation along the backside of the winder frame 11 and in unattached relation thereto. At its forward end, the short head arm 27 is mounted in suspended relation on the lower end of means for lowering and raising the lifter for operation, desirably comprising a fluid operated rectilinear actuator such as a pneumatic cylinder 29 pivotally attached on its upper end portion by means of a pivot 30 to a bracket 31 and extending downwardly and having a reciprocable piston rod 32 suitably coupled at its lower end to the forward end of the lifter arm 27. On its lower end portion, the vertical lifter arm 28 carries rigidly fixed thereto a forwardly extending lifting arm 33 in the form of a vertical plate which has in balanced relation below the piston rod 32 an upwardly opening front end lifting hook 34. The thickness of the lifting arm 33 is sufficiently less than the spacing between fairly closely adjacent web roll ends, as best seen in FIGS. 2 and 3, to be freely received between such ends.

In order to permit the use of individual tubular members as the cores 15 of the web rolls 14, such as the conventional cardboard core cylinders commonly employed for this purpose, and yet enable lifting of the web rolls 14 by means of the lifters 24, and more particularly the lifting hooks 34 thereof, hook-engageable shaft adapter means in the form of coupling plugs 35 are provided. In a desirable construction, each of the adapter shaft plugs 35 is provided with means to engage with and provide a lifting coupling for either end of one of the web rolls 14 or in both of the adjacent ends of contiguous web rolls, as shown in FIG. 3. To this end, a load bearing stub shaft 37 has opposite end portions of a length to extend a limited but significant distance into one of the cores 15. Desirably, the shaft 37 is stepped toward each end from a center portion, having reduced diameter end portions 38 on which are mounted bevel ended respective plugs 39 adapted to be received fairly closely but slidably within the end portion of one of the cores 15. Each of the plugs 39 may be secured as by means of a pin 40 to its shaft portion 38 and against a locating shoulder 41 at juncture of the shaft portion 38 with an intermediate diameter stepped portion 42 of the shaft about which is engaged one end portion of a tubular rider sleeve 44 which bridges between the plugs 39 and is accommodated within respective clearance recesses 45 which open toward one another. A lifter receiving gap between the adjacent ends of the plugs 39 is defined by respective radially outwardly extending stop flanges 47 on the inner ends of the plugs 39 for engaging the contiguous ends of the cores 15 and thereby maintaining them in suitable spaced relation. To receive and maintain the lifting element, that is the hook 34, in substantially centered relation in the gap between the flanges 47, the rider 44 is provided with an annular outer peripheral groove 48 having sidewalls which taper toward the bottom of the groove which is of substantially the same width as the thickness of the hook 34.

At the start of a winding operation cycle, suitable lengths of the cores 15 are placed in the trough of the winding rolls 12 and coupled together in end-to-end relation by means of the shaft adapter plug assemblies 35, with one of the adapter assemblies 35 plugged into each opposite end of the core assembly. Assembling of the core sections 15 and the adapters 35 may be effected directly in the winding roll trough, or the entire length of core sections 15 and adapters 35 may be preassembled and placed in the winding roll trough to conserve down time between winding cycles. The latter procedure would be preferred where the winder 10 is in on-stream relation to a paper making machine, but would not be as important where the winder 10 is merely in receiving relation to a web reel supply station. Then the leading end of the desired width of the webs are attached to the core sections 15 and with the rider roll 17 pressing down against the cores 15 with adequate winding pressure, the winding operation proceeds by powered rotation of the winding drums 12. As winding of the web roll 14 on each of the cores 15 proceeds, the rider roll 17 maintains progressively slackening roll winding pressure as the web roll diameter and thus weight increases until the web roll weight itself provides the proper pressure at the nips 23 for uniform lineal web tension during winding. The rider roll 17 then backs off and maintains a slightly spaced position relative to the perimeter of the expanding web roll 14, serving then as merely a safety restraint against any possible tendency for the web roll 14 to displace from the winding rolls 12 during high speed winding.

Until the web roll winding progresses to zero pressure demand from the rider roll 17, each of the lifters 24 remains inactive. Prior to start of a winding operation, each of the lifters 24 is properly oriented with respect to the length of web rolls to be accommodated, that is one each of the lifters 24 is located at the respective opposite ends of the string of coupled cores whereby to be selectively engageable with the respective shaft adapters 35 at such ends, and others of the lifters 24 are positioned for selective engagement with each of the shaft adapters 35 between the several core sections. To facilitate accurate individual adjustments of the lifters 24 along the width of the winder 10, means are provided for mounting the supporting brackets 31 of the lifters adjustably on the winding frame 11 such as on a beam 50 extending along the top of the frame 11. Releasable means connecting each of the brackets 31 to the beam 50 comprise T-bolts 51 engaged in complementary T-shaped slots 52 in rails provided along the beam 50. By loosening the bolts 52, the brackets 31 and thereby the lifter 24 can be moved incrementally along the winder 10 into the desired position. To facilitate such adjustment of the lifter 24, shifting means may be provided such as a handwheel 53 for driving a pinion 54 along a rack 55 carried by the beam 50. Thus, with the bolts 51 loosened, manipulation of the handwheel 53 will adjust the lifter 24 into the accurate selected position along the winder 10, at which position the lifter can then be fixed by tightening the bolts 51.

Figure 4:
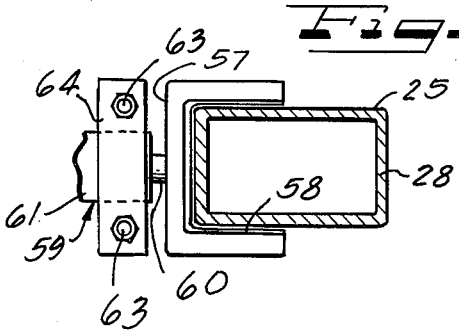
FIG. 4 is an enlarged fragmentary horizontal sectional plan detail view taken substantially along the line IV—IV of FIG. 1.

By reason of its generally C-shape, the lifter 24 normally tends to swing by gravity into lifting position. Means are therefore provided for shifting the lifter 24 to a non-lifting, inactive position when it is not needed, more particularly when the lifting arm 33 would interfere with loading a core assembly into position on the winding rolls 12, and clearance for operation of the rider roll 17 is necessary. For this purpose, a control yoke 57 (FIGS. 1 and 4) is provided to engage slidably with the leg 28 of the lifter at the inner side of the lifter frame 25. For relatively frictionless sliding engagement with the lifter frame leg 28, the inside surfaces of the yoke 57 are desirably lined with suitable anti-friction plastic material such as nylon or tetrafluoroethylene. Means for actuating the yoke 57 conveniently comprise a fluid actuator 59 such as a pneumatic piston and cylinder unit having a reciprocable piston rod 60 fixed to the yoke 57 and a cylinder 61 which is mounted adjustably on the adjacent frame beam 20. Means for adjustably securing the cylinder 61 along the beam 20 comprise a T-groove rail 62 within which one or more T-bolts 63 are engaged for securing a bracket 64 rigid with the cylinder 61. Through this arrangement, the controlling yoke 67 can by loosening the bolts 63 be adjusted along the winder 10 concurrently with adjustment of the associated lifter 24. In the adjusted position tightening of the bolts 63 locks the yoke 57 for operation in the adjusted position of the lifter 24.

At the beginning of a winding cycle, the actuator 59 operates to drive the yoke 57 outwardly to swing the lifter 24 about the head end pivot 30 to shift the lifting arm 33 into full clearance backed away relation to the rider roll 17. At the same time, the lifting cylinder 29 operates to drop the lifter frame 25 to a lowered position as shown in the double dot dash outline in FIG. 1 wherein the lifter arm 33 is poised for movement into lifting engagement with the associated shaft adapter 35 when the size of the web roll 14 has developed sufficiently to increase its weight to a value at which the winding pressure at the nips 23 needs relief. For example, such weight may be attained in a newsprint paper roll at about 30 inch diameter. Thereupon, the actuator 59 is operated to retract the control yoke 57, permitting the lifter 24 to swing inwardly until the lifter arm 33 is in position as indicated in dash outline in FIG. 1 wherein the lifting hook 34 is engageable with the rider sleeve 44 of the associated shaft adapter 35. At this time, the cylinder actuator 29 operates to apply a lifting force through the piston rod 32 on the lifter 24 correlated to the progressively increasing diameter and weight of the web roll 14 to maintain optimum winding pressure at the nips 23. Any suitable means for effecting operation of the actuators 29 and 59 including suitable electro-pneumatic circuitry, including load cell means and other desirable controlling means permitting automatic or manually controlled operation may be provided. Such means are readily available and need therefore not be more particularly described. Lifting progresses proportionally as the diameter and weight of the web roll 14 increases while the lifter 24 follows the upward progress of the cores 15 of the increasing diameter web rolls, coming into a stop as shown in the full line position in FIG. 1 when the maximum diameter of the web roll 14 has been reached and the winding is brought to a halt by stopping the winding rolls 12. At this point, the lifter 24 is dropped sufficiently to disengage it from the associated adapter shaft 35, as for example to the lowered position indicated by dot dash outline in FIG. 1, and the completed web roll 14 is ejected from the winder 10.

Means for ejecting the completed web rolls 14 from the winder 10 comprise an ejector beam 65 which may be suitably mounted in normally clearance relation to the winding space within the winder frame 11. On completion of the web roll 14, the ejector 65 is adapted to be actuated as by means of a suitable actuator 67 to dump the finished web rolls 14 from the winder 10 in the direction of the indicating arrrow, away from the disengaged lifters 24, thereby clearing the winder 10 for a repeated winding cycle.

It will be understood, of course, that all of the lifters 24 associated with the winder 10 are operated in unison in all phases of the winding cycle in which the lifters are employed. In the operating and control circuitry, the lifting force applied by the respective actuators 29 will be monitored and controlled for uniformity of action and lifting throughout the length of the coupled cores 15. At the opposite ends of the series of web rolls 14, the respective lifter actuators 29 will, of course, be required to lift only about half the load that the actuators 29 for lifters 24 located between any two adjacent web rolls will be required to lift. Such differential in lifting forces is easily attained by conventional fluid actuator controls.

From the foregoing it will be appreciated that pursuant to the present invention substantially larger web rolls can be satisfactorily wound and thus more end product tonnage provided with less downtime between winding cycles. More intensive use of winder and associated equipment is attained. Therefore significant production economies are effected.

It will be understood that variations and modifications may be effected without departing from the spirit and scope of the novel concepts of this invention.

I claim as my invention:

1. A method of controlling internal lineal tension in web rolls during winding thereof about cores with the aid of winding drums, comprising:

partially winding the web rolls between nips at the winding drums and a rider roll which acts through the web rolls to provide controlled tensioning load to said nips until the weight of the web rolls themselves provides sufficient self-loading on the nips for lineal tensioning of the webs in the rolls;

then releasing the rider roll from the web rolls; and during continuance of winding the web rolls to full desired diameter applying load relieving lift to the web rolls through their cores to maintain the web tensioning load at said nips at a substantially optimum value as web load weight increases.

2. A method according to claim 1, comprising inserting shaft adapter means into end portions of the web roll cores, and applying the load relieving lift to said shaft adapters.

3. A method according to claim 1, comprising proportionately increasing load relieving lift force relative to progressively increasing weight of the web rolls.

4. A method according to claim 1, including at full diameter of the web rolls terminating said load relieving lift and ejecting the web rolls from said drums.

5. A method according to claim 1, comprising initially laying web roll cores into a trough provided by the winding drums, starting web material onto the cores while the rider roll applies tensioning load to the cores and started web material toward the nips at the winding drums, and after the web rolls have reached said self-loading weight applying lifting devices to core shaft means carried by the cores in thereby applying the load relieving lift to the cores.

6. Apparatus for controlling internal lineal tensioning in web rolls during winding thereof about cores, comprising:

winding drums on which the web rolls are in nip engagement;

a rider roll which imposes lineal web tensioning load on the web rolls toward said nips until the web rolls are partially wound and the weight of the web rolls themselves provide self-loading of the nips to maintain the lineal tension;

means for releasing the rider roll from the web rolls when the web rolls have attained self-loading weight; and means operating during continuance of the winding of the web rolls on the drums for applying load relieving lift to the web rolls through their cores to maintain the web tensioning load at said nips at a substantially optimum value until the web rolls have attained full sized diameter and weight.

7. Apparatus according to claim 6, including shaft adapter means to be inserted into end portions of the web roll cores, said relieving means being applied to said shift adapter means to effect the load relieving lift.

8. Apparatus according to claim 6, including means operating with said load relieving lift applying means to proportionately increase the lifting force relative to progressively increasing weight of the web rolls during winding.

9. Apparatus according to claim 6, wherein said load relieving lift applying means are arranged to terminate load relieving lift when the web rolls have attained full diameter, and means for ejecting the full diameter web rolls from said drums.

10. Apparatus according to claim 6, comprising core shaft means connecting the cores so that the cores can be initially laid into a trough provided by the winding drums and the web material started onto the cores while the rider roll applies tensioning load to the cores and the started web material toward the nips at the winding drums, and said load relieving lift applying means being operable from an inactive position to engage said core shaft means after the web rolls have reached a self-loading weight for thereafter applying load relieving lift to the cores through said shaft means.

11. Apparatus according to claim 6, wherein said lifting means comprise a generally vertically swinging device including a lifting arm, means for supporting the arm, and means for operating said device.

12. Apparatus according to claim 11, wherein said operating means comprise means for actuating the device in a vertical direction.

13. Apparatus according to claim 11, wherein said operating means include means for swinging the device relative to said web rolls.

14. Apparatus according to claim 11, including adapter shaft means for engagement in the end portions of the web roll cores and having engagement areas thereof exposed at the ends of the cores, and said lifting arm having a hook terminal portion engageable selectively in lifting relation with the engagement area of one of the adapter shaft areas.

15. Apparatus according to claim 11, including means for effecting adjustments of the lifting device along the supporting means to accommodate variable lengths of web rolls.

16. A winder apparatus for simultaneously winding a slit web onto a plurality of adjacent rolls on a common axis comprising in combination:

axially extending shaft means for core means for receiving a plurality of webs and winding them onto a plurality of rolls;

and support means engageable with the shaft means between adjacent rolls for applying a vertical force thereto preventing downward deflection of the shaft means and preventing interference between adjacent rolls due to downward deflection of the axis.

17. A winder apparatus for simultaneously winding a slit web onto a plurality of adjacent rolls on a common axis constructed in accordance with claim 16, wherein said support means includes means extending diametrically inwardly from externally of the rolls and between the ends of the rolls for engagement with the shaft means.

18. A winder apparatus for simultaneously winding a slit web onto a plurality of adjacent rolls on a common axis constructed in accordance with claim 16, and including a vertical force applying means connected to said support means operative to apply a variable force increasing with the diameter and weight of the roll.

19. The method of winding a slit web into a plurality of adjacent rolls on a common axis comprising the steps:

winding adjacent strips of a web onto adjacent rolls on a common axis;

and applying a vertical support force to the axis between the rolls by engagement with the axis between the rolls by a support means applying a vertical force preventing downward deflection of the axis so that the rolls remain parallel and interference therebetween is avoided.

20. The method of winding a slit web into a plurality of adjacent rolls on a common axis in accordance with the steps of claim 19, wherein the force applied increases proportionately to the size and weight of the rolls.

* * * * *

UNITED STATES PATENT AND TRADEMARK OFFICE

CERTIFICATE OF CORRECTION

PATENT NO. : 3,937,410

DATED : February 10, 1976

INVENTOR(S) : Edgar J. Justus

It is certified that error appears in the above-identified patent and that said Letters Patent are hereby corrected as shown below:

Column 6, line 66, please delete "on" and insert --of--.

Signed and Sealed this

Twenty-seventh Day of July 1976

[SEAL]

*Attest:*

RUTH C. MASON
*Attesting Officer*

C. MARSHALL DANN
*Commissioner of Patents and Trademarks*